US007762430B2

(12) United States Patent
Wild et al.

(10) Patent No.: US 7,762,430 B2
(45) Date of Patent: Jul. 27, 2010

(54) CLOSING ELEMENT WITH OUTLET CHANNEL EXTENDING IN FUNNEL-LIKE MANNER

(75) Inventors: Hans-Peter Wild, Eppelheim (DE); Erhard Schwartz, Wiesloch (DE)

(73) Assignee: Deutsche Sisi-Werke GmbH & Co. Betriebs KG, Heidelberg (DE)

( * ) Notice: Subject to any disclaimer, the term of this patent is extended or adjusted under 35 U.S.C. 154(b) by 540 days.

(21) Appl. No.: 10/739,548

(22) Filed: Dec. 18, 2003

(65) Prior Publication Data

US 2004/0155045 A1 Aug. 12, 2004

(30) Foreign Application Priority Data

Dec. 23, 2002 (EP) ..... 02028874

(51) Int. Cl.
*B65D 35/00* (2006.01)

(52) U.S. Cl. ..... 222/107; 383/906

(58) Field of Classification Search ..... 222/92, 222/107, 562, 566, 105, 591.1, 591.9; 383/906, 383/906.8; 220/601, 613, 359
See application file for complete search history.

(56) References Cited

U.S. PATENT DOCUMENTS

| | | | | | |
|---|---|---|---|---|---|
| 3,690,524 | A * | 9/1972 | Haberhauer | ..... | 222/573 |
| 3,822,811 | A * | 7/1974 | Landen | ..... | 222/562 |
| 5,823,393 | A * | 10/1998 | Hafstrom | ..... | 222/130 |
| 6,050,451 | A * | 4/2000 | Hess et al. | ..... | 222/92 |
| 6,273,307 | B1 * | 8/2001 | Gross et al. | ..... | 222/92 |
| 6,439,429 | B1 * | 8/2002 | Gross | ..... | 222/92 |
| 6,860,406 | B2 * | 3/2005 | Kobetsky et al. | ..... | 222/92 |
| 2002/0048742 | A1 * | 4/2002 | Pierson | ..... | 222/566 |
| 2005/0040181 | A1 * | 2/2005 | Kurosawa et al. | ..... | 222/92 |

FOREIGN PATENT DOCUMENTS

| | | | | | |
|---|---|---|---|---|---|
| CH | 677093 | A5 | | 4/1991 | |
| CH | 680358 | A5 | | 8/1992 | |
| DE | 1921349 | A1 | | 11/1970 | |
| EP | 0145691 | | * | 3/1991 | ..... 222/92 |
| EP | 103484 | A2 | | 5/2001 | |
| EP | 103484 | A3 | | 5/2001 | |
| EP | 1449784 | | * | 8/2004 | ..... 222/92 |
| FR | 2715636 | | | 8/1995 | |
| JP | 9-249237 | | * | 9/1997 | ..... 222/92 |
| JP | 10-167294 | | * | 6/1998 | ..... 222/92 |
| JP | 10203542 | A1 | | 8/1998 | |
| JP | 11-255250 | | * | 9/1999 | ..... 222/92 |
| JP | 2000335604 | | | 5/2000 | |
| JP | 2000-296858 | | * | 10/2000 | ..... 222/92 |
| JP | 200229552 | | | 1/2002 | |
| JP | 2002104443 | | | 4/2002 | |
| WO | WO 96/21599 | | * | 7/1996 | ..... 222/92 |

* cited by examiner

*Primary Examiner*—Lien T Ngo
(74) *Attorney, Agent, or Firm*—Stroock & Stroock & Lavan LLP

(57) ABSTRACT

A closing element for a packaging for receiving liquid or paste-like material, especially for film bags, and having a closable spout member, a weld member adjoining the closable spout member, and an outlet channel which extends through the weld member and the spout member, and also a film bag comprising such a closing element. To improve the pouring characteristics and for an easier emptying of the contents of the bag, the outlet channel in the weld member extends at least in part in funnel-like manner towards the spout member.

22 Claims, 7 Drawing Sheets

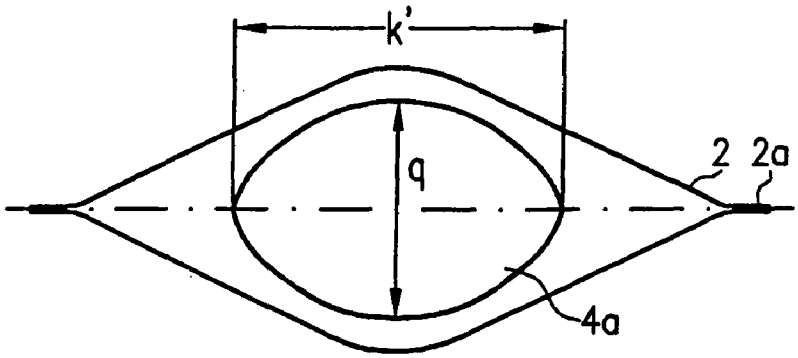
Fig.3d
Fig. 4
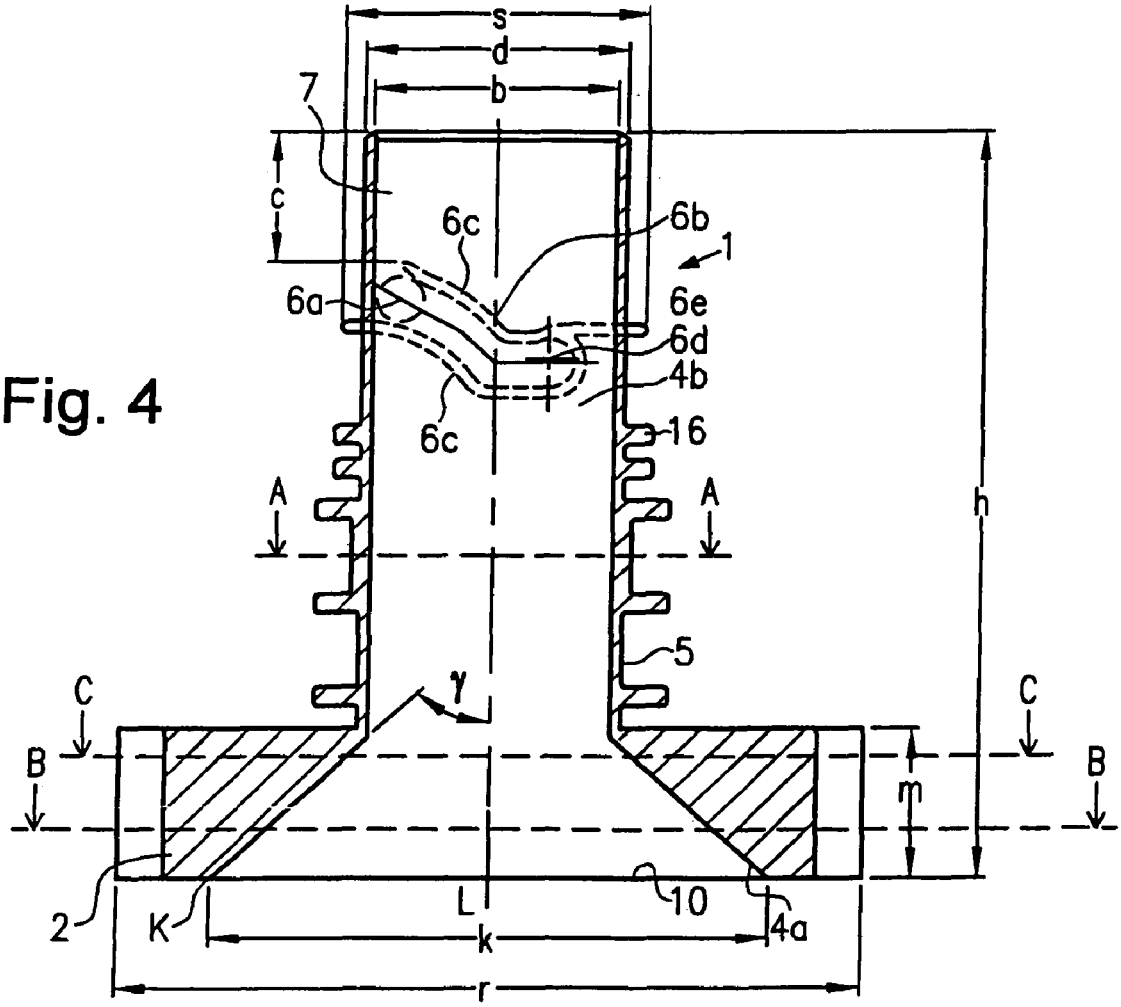

CLOSING ELEMENT WITH OUTLET CHANNEL EXTENDING IN FUNNEL-LIKE MANNER

FIELD OF THE INVENTION

The invention relates to a closing element for a packaging for receiving liquid or paste-like material, especially for a film bag.

BACKGROUND OF THE INVENTION

Packaging for receiving liquid or paste-like material, especially film bags, is used on a large scale, especially as beverage containers or also for cosmetics, detergents, etc.

Beverage containers are still opened most of the time with the help of straws that are pierced into a piercing region. This has the drawback that, after having been opened once, beverage containers cannot be closed again. When the contents of the container is not completely drained off after the opening operation, there is the risk that the rest will leak out or that the filling material may perish rapidly. Therefore, film bags have already been developed that are to be closed with screw closures. Such a bag is shown in FIG. 10. A closing element 31 (also called boat) is welded with the weld member 32 in the upper region between the two side walls of the bag 30 with the weld seams 35. The closing element has an internally extending outlet channel 34 shown in broken line, which can be closed at the top by a screw type closure 36. The outlet channel is realized in the manner of a straight through hole, terminating in the flat bottom side located in the interior of the bag. The problem arises here that the outflow characteristics in the standard pouring position, in which the bag is e.g. tilted to the left in the drawing, are not optimum and that a complete emptying operation can only be realized with difficulties. Residual liquid may remain in the corner portions. Even if the bag is turned completely upside down, residual liquid may accumulate on the bottom side of the closing element or the inner edges of the side walls and will not run off. This is of disadvantage to some applications, e.g. during aseptic filling, because no residues of the rinsing liquid are allowed to remain in the bag.

SUMMARY OF THE INVENTION

It is therefore the object of the present invention to provide a closing element for a container for receiving liquid or paste-like material, especially for film bags, and a film bag having such a closure that provides improved outflow characteristics and an improved emptying of the contents of the container.

According to the invention said object is achieved by the characterizing features of claim 1.

Since the outlet channel in the weld member extends at least in part in funnel-like manner towards the spout member, this yields better outflow characteristics because the liquid in the tilted position is guided towards the spout member. When the remaining contents of the bag is removed, no liquid will remain in the lower portion of the weld member (portion A in FIG. 10), but will flow off entirely.

"At least in part funnel-like" means in this instance that the outlet channel need not extend in funnel-like or conical manner towards the outlet throughout the whole portion of the weld member. Even an only partly formed funnel-like extension of the outlet channel effects the advantages aimed at. It should also be noted that funnel-like in connection with claim 1 need not necessarily mean rotationally symmetrical with the longitudinal axis of the closing element.

The angle of inclination $\gamma$ with which the inclined portion of the outlet channel extends towards the longitudinal axis of the closing element can vary within large ranges and be almost 90°, but it is preferably in a range between 20° and 85°, even better between 30° and 75°.

When the funnel-like outlet channel in the weld member is e.g. not rotationally symmetrical relative to the longitudinal axis of the closing element, the longitudinal extension of the weld member is e.g. larger than the extension in the direction of width, the length of the outlet channel in the weld member decreasing continuously towards the spout member from the longitudinal direction to the widthwise direction. (In the weld member the outlet channel will then have the shape of a folded paper hat slightly opened by pressing on the side edges). In comparison with the known closing elements this will even save material, which will considerably reduce the production costs in view of the fact that this is a mass article that is used millions of times.

With such a configuration the width in the middle of the outlet channel remains constant in the weld member in the pouring direction.

According to a preferred embodiment the outlet channel at the end of the weld member facing away from the spout member extends first approximately parallel (optionally with a slight inclination for facilitating shaping in the case of a closing element produced by injection molding) towards the longitudinal axis L of the closing element and will only narrow subsequently towards the spout member.

Preferably the outlet channel in the spout member has a hollow cylindrical shape or tapers conically in outflow direction.

The spout member may be closable with a screw closure or also via a bayonet lock with a cap.

According to a preferred embodiment the closing element is particularly used in beverage containers as a mouthpiece. The spout member will then have a smooth surface at its end facing away from the weld member. When the spout member is closed via a bayonet lock with a cap, the smooth surface can easily be realized above the bayonet lock.

It is advantageous when the weld member is provided with seal beads extending on its side surfaces. Two seal beads, for example, may be provided spaced apart from the upper and lower edges of the weld member. The beads of sealable material will prevent molten material from flowing off over the edges of the weld member while the weld member is being welded in.

A film bag of the invention comprises the closing element of the invention, in the case of which the outlet channel in the weld member extends at least in part in funnel-like manner towards the spout member.

The closing element may be welded or adhesively fixed at the top between the side walls in the middle or also in a corner portion.

In the welded state of the closing element, so-called bag shoulders (see e.g. area B in FIG. 10) are created at the left and right side. According to a preferred embodiment the bag shoulders next to the closing element are welded off from an outer edge of the bag obliquely towards the closing element by corresponding weld seams, so that no liquid residues will accumulate in the shoulders of the bag during the emptying process.

Preferably, the weld seams meet the lower edge of the side surface of the weld member that is facing the interior of the bag. Hence, the dead volume in which residual liquid might accumulate during emptying can be reduced to a further degree because the weld seams form some kind of extension of the spout channel tapering in the pouring direction.

BRIEF DESCRIPTION OF THE DRAWINGS

Embodiments of the invention will now be explained in more detail with reference to the figures, of which:

FIG. 3*d* is a section along line C-C in FIGS. 3*a* and 4;

FIG. 4 is a longitudinal section through a closing element according to a further embodiment of the invention;

DETAILED DESCRIPTION OF THE INVENTION

Figure 1B:
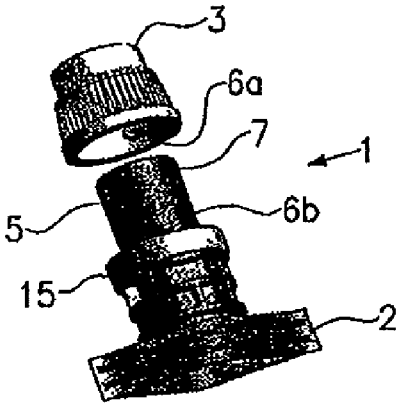
FIGS. 1*a* and 1*b* are perspective views of a first embodiment of a closing element according to the invention.
Figure 1A:
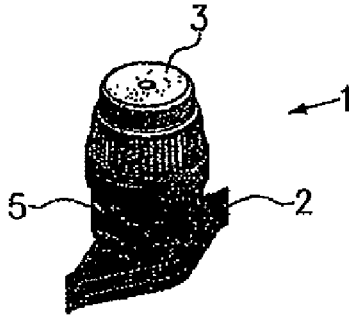

FIGS. 1*a* and *b*, respectively, are perspective views showing a closing element according to the invention. As a rule, closing elements of this type can be used for closing very different containers. However, they are preferably used for flexible film bags. This is why the following description will refer to this type of application.

The closing element 1 is produced as an injection-molded part and comprises a closable spout member 5 and a weld member 2 adjoining the closable spout member 5. As becomes apparent from FIGS. 3*a, b, c, d* and 4, an outlet channel 4*a, b* extends through the weld member 2 and the spout member 5. The outlet channel 4*b* in the spout member 5 is e.g. configured as a hollow cylinder and has a diameter b of 5 to 20 mm. The outer diameter of the closable spout member 4*b* is within a range of from 6 to 25 mm. In the weld member 2, the outlet channel 4*a* extends in funnel-like manner towards the spout member 5.

Figure 3A:
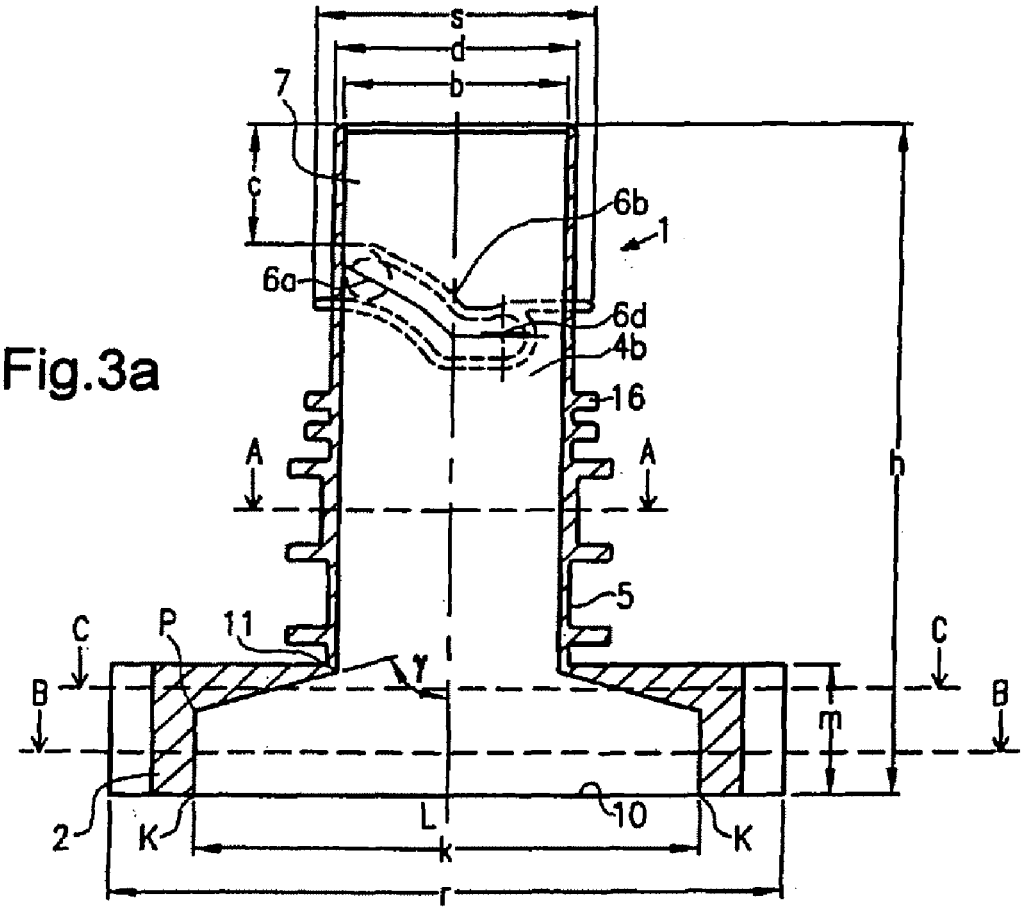
FIG. 3*a* is a longitudinal section along line III*a*-III*a* of FIG. 2*b;*

In the embodiment shown in FIG. 3*a*, the outlet channel 4*a* at the end 10 of the weld member 2 facing away from the spout member extends first approximately in parallel with the longitudinal axis L of the closing element up to a point P and then tapers from point P towards the spout member 5 until it assumes diameter b of the outlet channel 4*b* in spout member 5. The outlet channel 4*a* in the weld member 2 extends at an angle γ of about 75° relative to the longitudinal axis L of the closing element. Said angle may however vary within wide ranges. Height m of the weld member 2 ranges from 5 to 20 mm. Height h of the whole closing element 1 is within a range of 15 to 70 mm. Weld member 2 has a length r of 10 to 70 mm and ends flat in its end portions 2*a*, as becomes apparent from FIGS. 1 and 3*b*. This means that the longitudinal extension k of the outlet channel 4*a* in the weld member 2 is greater than the extension in the direction of width q. The ratio of the diameter b of the outlet channel 4*b* in the spout member 5 to length k of the outlet channel 4*b* at the end 10 facing away from the spout member is between 0.1 and 0.7. Width q in the middle of the outlet channel 4*a* is substantially identical with the cross section b of the outlet channel 4*b* in the spout member 5.

As follows from FIGS. 3*b* and 3*d*, length k of the outlet channel 4*b* in the direction of spout member 5 decreases continuously from point P until it is identical with the diameter b of the outlet channel 4*a* in spout member 5. As follows from sections B-B and C-C in FIGS. 3*b* and *d*, dimension k' at the cutting line C-C is smaller than dimension k at B-B while width q of the outlet channel 4*b* in the direction of spout member 5 remains substantially constant. Hence, the expression "funnel-like" extension does not mean in this instance that this is a funnel that is rotationally symmetrical about the longitudinal axis L. What is essential is that the outlet channel in the weld member 2 tapers in outlet direction.

Figure 3B:
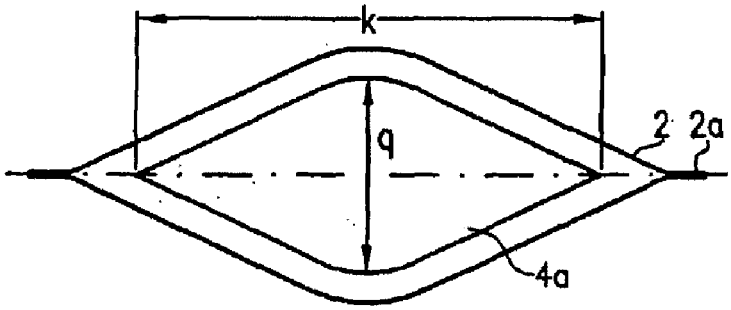
FIG. 3*b* is a section along line B-B in FIGS. 3*a* and 4.
Figure 3C:
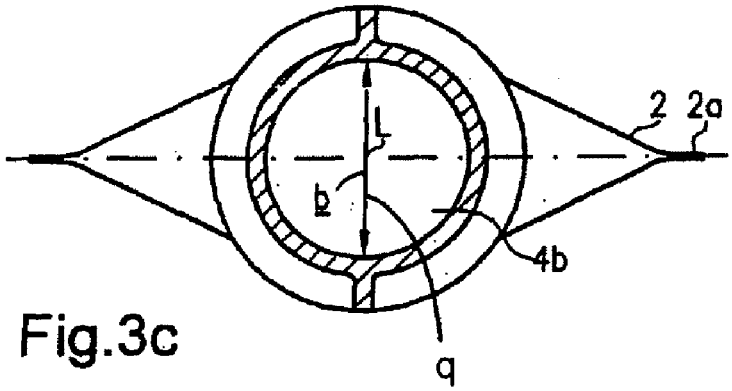
FIG. 3*c* is a section along line A-A in FIGS. 3*a* and 4.
Figure 3E:
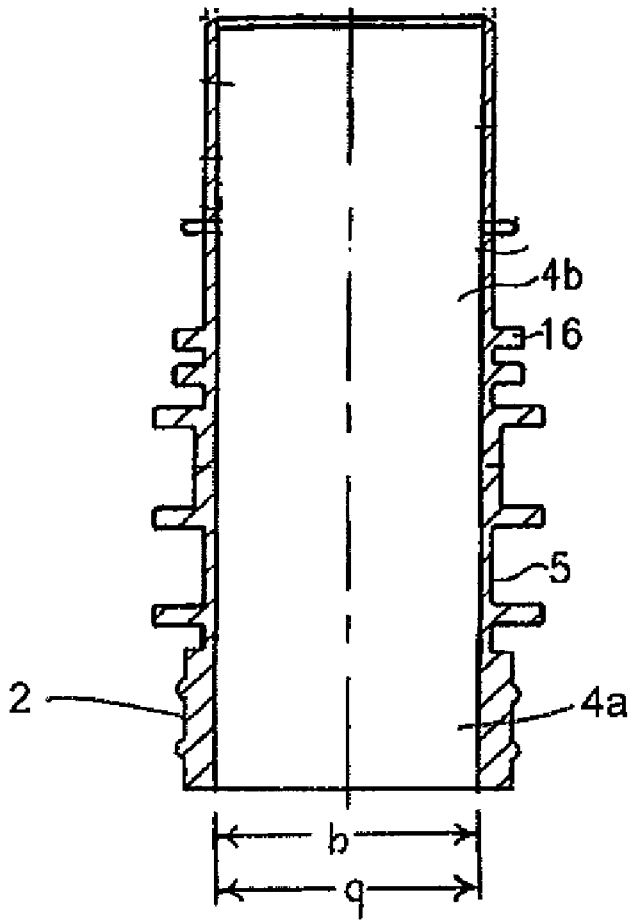
FIG. 3*e* is a longitudinal section along line IIIe-IIIe of FIG. 2*a;*

FIG. 4 shows a further embodiment of the closing element of the invention, which is identical with the closing element shown in FIG. 3*a*, except for the feature that at the beginning the outlet channel 4*a* in the weld member 2 does not extend in parallel with the longitudinal axis L of the closing element, but length k of the weld member 2 decreases continuously from the lower end of the weld member 2 until it is identical with the diameter b of the outlet channel 4*b* in the spout member 5 (see also FIGS. 3*b* to *d*).

Since, as shown in FIGS. 3 and 4, the outlet channel 4*a* tapers in the weld member 2 in funnel-like fashion towards the spout member 5, liquid can flow off easily from the film bag without any accumulations in the lateral edge portions of the weld member.

The closing elements shown in FIGS. 3 and 4 are formed as a boat, i.e. their longitudinal extension is larger than their extension in widthwise direction. Of course, closing elements are also possible that have e.g. a round cross-section, or the outlet channel of which extends in rotational symmetry with a central longitudinal axis of the closing element. Furthermore, in connection with FIGS. 3 and 4, there are shown embodiments in the case of which the outlet channel 4*a* will extend in funnel-like fashion in the weld member 2 until it has assumed the dimensions of the outlet channel in spout member 5 at a point 11, said point 11 marking the transition between weld member 2 and spout member 5. Of course, as shown in FIG. 8*a*, the outlet channel 4*a* may already assume diameter b of the outlet channel 4*b* in the weld member 2.

Figure 8A:
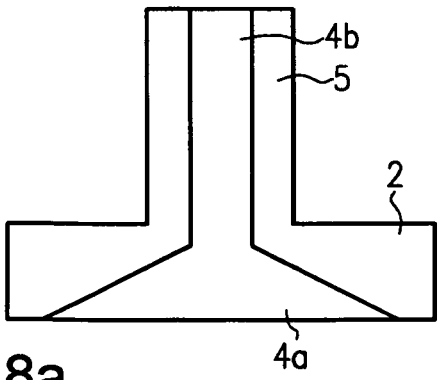
FIGS. 8*a, b, c* show schematized further embodiments of closing elements according to the invention.
Figure 8B:
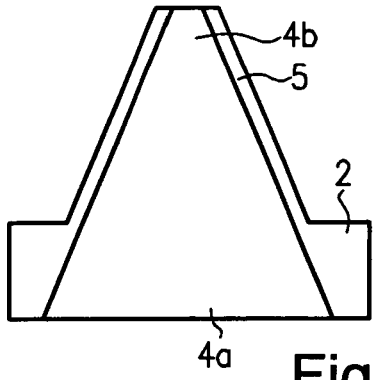
Figure 8C:
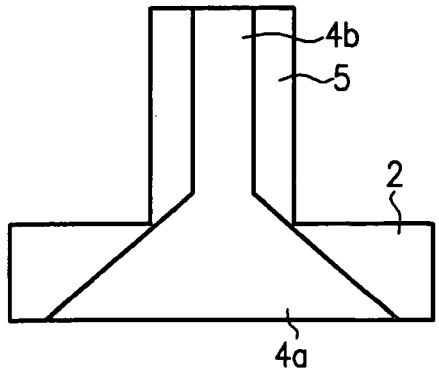

The embodiments shown in FIGS. 8*a* and 3*a* are examples in which the outlet channel 4*a* extends conically only in part while parts of the outlet channel 4*a* extend e.g. in parallel with the central longitudinal axis. It is also possible, as shown in FIG. 8*c*, that the funnel-like extension of the outlet channel 4*a* is continued at least in part (FIG. 8*c*) or completely (FIG. 8*b*) in the channel section 4*b* within the spout member 5.

Figure 2A:
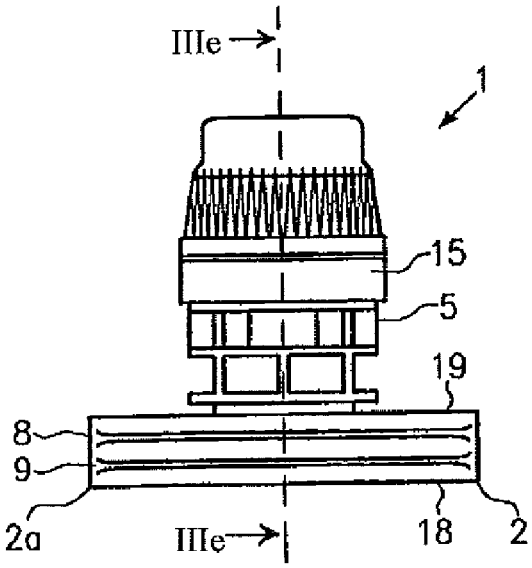
FIG. 2*a* s a front view of the closing element shown in FIG. 1.
Figure 2B:
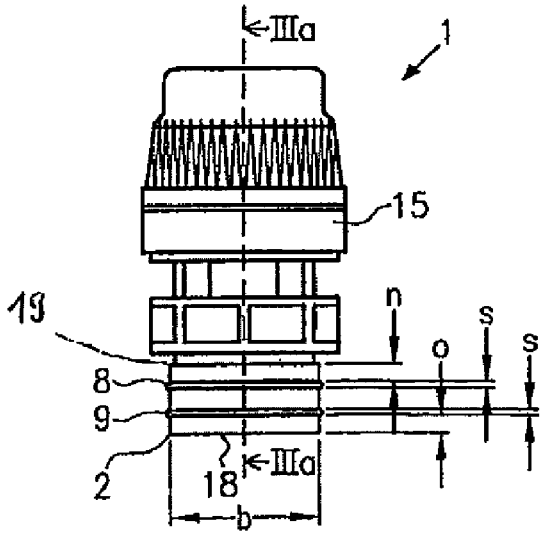
FIG. 2*b* s a side view of the closing element shown in FIG. 2*a;*

With reference to FIGS. 1 and 2, it becomes apparent that two attached seal beads 8, 9 (see FIG. 2*b*) extend on the side surfaces of the weld member 2 in spaced-apart configuration with respect to the upper and lower edge 18, 19 of the weld member 2. The beads 8 and 9 consist of sealable material, preferably material from which the weld member 2 itself is formed. Distance n, o of beads 8 and 9 from the respective upper and lower edges 18, 19 is within a range of 0.5 to 5 mm. Beads 8, 9 extend over the length of the side walls and have the effect that whenever the weld member 2 is welded between two film bag sides the molten material will not run over the bag edge. Polyethylene, polypropylene and many modifications based on said raw materials, or also other thermoplastic materials, serve e.g. as the material for the weld member and for the beads, respectively.

In the embodiment according to FIGS. 1*b* and 3*a*, 4 and 5, the spout member 5 is closed with a bayonet lock formed by a guide slot 6*b* and a pin 6*a* and including a cap 3. The guide slot 6*b* is positioned on the smooth surface of the spout member 5 above the flange 16 and cooperates with the pin 6*a* provided on the inside of the cap (see FIGS. 1*b*, 3*a* and 4), the pin 6*a* being moved up to stop 6*d* upon rotation of the cap 3 in the guide slot. The guide slot is formed by the guide webs 6*c* (FIG. 4), the upper web guiding the cap downwards during sliding of the pin until the pin in stop portion 6*b* snaps with a slight bias upwards into the small enlargement 6*e* formed at said place.

Figure 5:
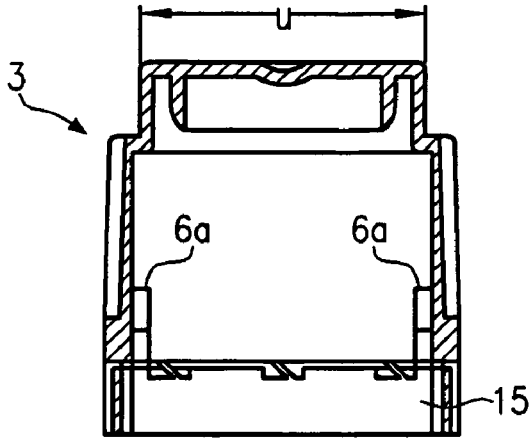
FIG. 5 is a section through a cap for closing the closing element.

It is also possible to provide two of said bayonet locks on the opposite sides of the spout member 5, two opposite pins 6*a* being then formed in cap 3 (see FIG. 5). It is also possible to provide the guide webs on the inside of the cap and the pins on the spout member.

The cap 3 seals the spout member 5 in the closed state at the upper end. Furthermore, as follows from FIG. 5, the cap 3 has a pull-off ring 15 which in the known way comprises several individual or coherent and surrounding locking cams distributed on the circumference and provides tamper-proofness. When the closing element 1 is opened for the first time, the pull-off ring will tear off due to the rotational movement of the cap.

Cap 3 has an upper region whose inner diameter has been chosen such that it can receive and seal the upper region of the spout member 5. The lower region of the cap has a larger inner diameter because it must receive the projecting ends of the guide Webs 66*b* of the bayonet lock.

As follows from FIGS. 3 and 4, a smooth portion 7 is formed above the bayonet lock 6*b* with a dimension c of 4 to 25 mm, said portion 7 serving as a mouthpiece.

Figure 6:
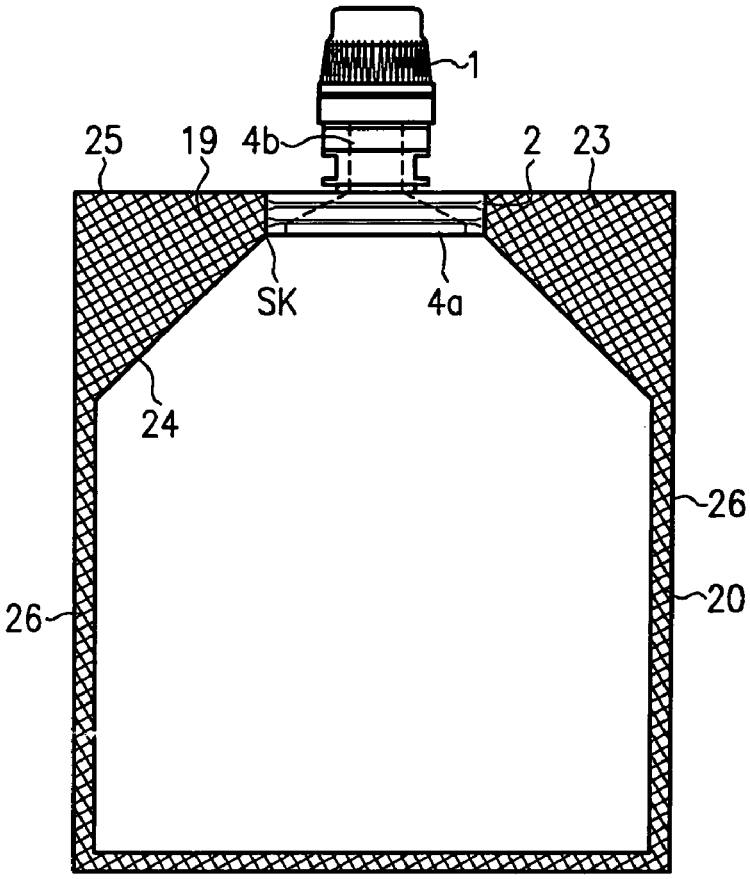
FIG. 6 is a schematic front view of a film bag with closing element according to an embodiment of the invention.

FIG. 6 shows an embodiment of a film bag according to the invention. The closing element 1 is welded into the film bag 20 between the side walls such that the longer side of the weld member 2 extends in parallel with the upper edge 25 of the bag 20. The welded closing element 1 corresponds to the closing elements 1 explained in connection with FIGS. 1 to 5 and 8. Bag shoulders 23 are created at the left and right side next to the closing element 1. To prevent residual liquid from remaining in the bag shoulders 23 when liquid is poured out of the bag 20, the bag shoulders 23 are obliquely welded off next to the weld member 2 by weld seams 24. Each of the seams 23 extends from the longitudinal edge 26 obliquely in outlet direction upwards, preferably meeting the lower outer edge of the tip 2*a* (cf. FIG. 3*b*) of the weld member that is facing the interior of the bag. Due to the combined action of the seams 24 and the funnel-like outlet channel 4*a*, the filling material can flow unhindered to the outside in outlet direction under good flow conditions without residues remaining in possible dead spaces. The weld seams 24 thus form an extension of the outlet channel 4*a*.

Figure 7:
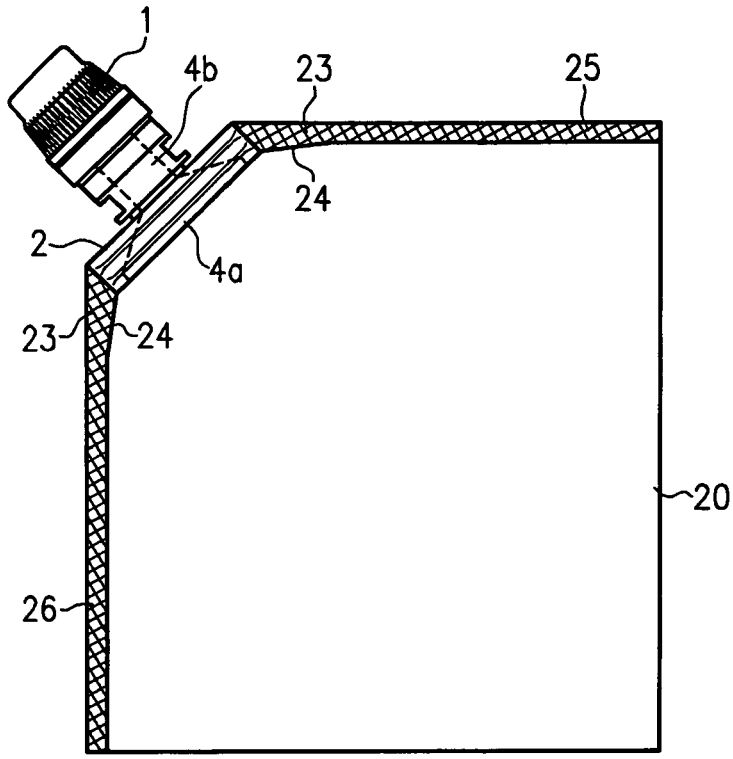
FIG. 7 is a schematic front view of a film bag with a closing element according to a further embodiment of the invention.

FIG. 7 shows a further embodiment, which is substantially identical with the embodiment shown in FIG. 6, but the closing element 1 is welded into a corner portion between the side walls of the bag 20. The weld seams 24 extend from the longitudinal edge 26 of the bag and the upper edge 25 to the lower outer edge of the weld member 2 facing the interior of the bag. When the bag 20 is tilted downwards for emptying purposes together with the closing element 1, the filling material can easily flow off via the weld seams 24, the lower surface of the weld member and the adjoining outlet channel 4*a*, which extends in funnel-like fashion towards the spout member 5, and the adjoining outlet channel 4*b* in spout member 5, without residues collecting in the bag 20. Hence, a complete emptying of the bag is possible. Unlike the situation shown in FIG. 7, the weld seam 24, however, could also extend in line with the lower edge of the weld member.

Figure 9:
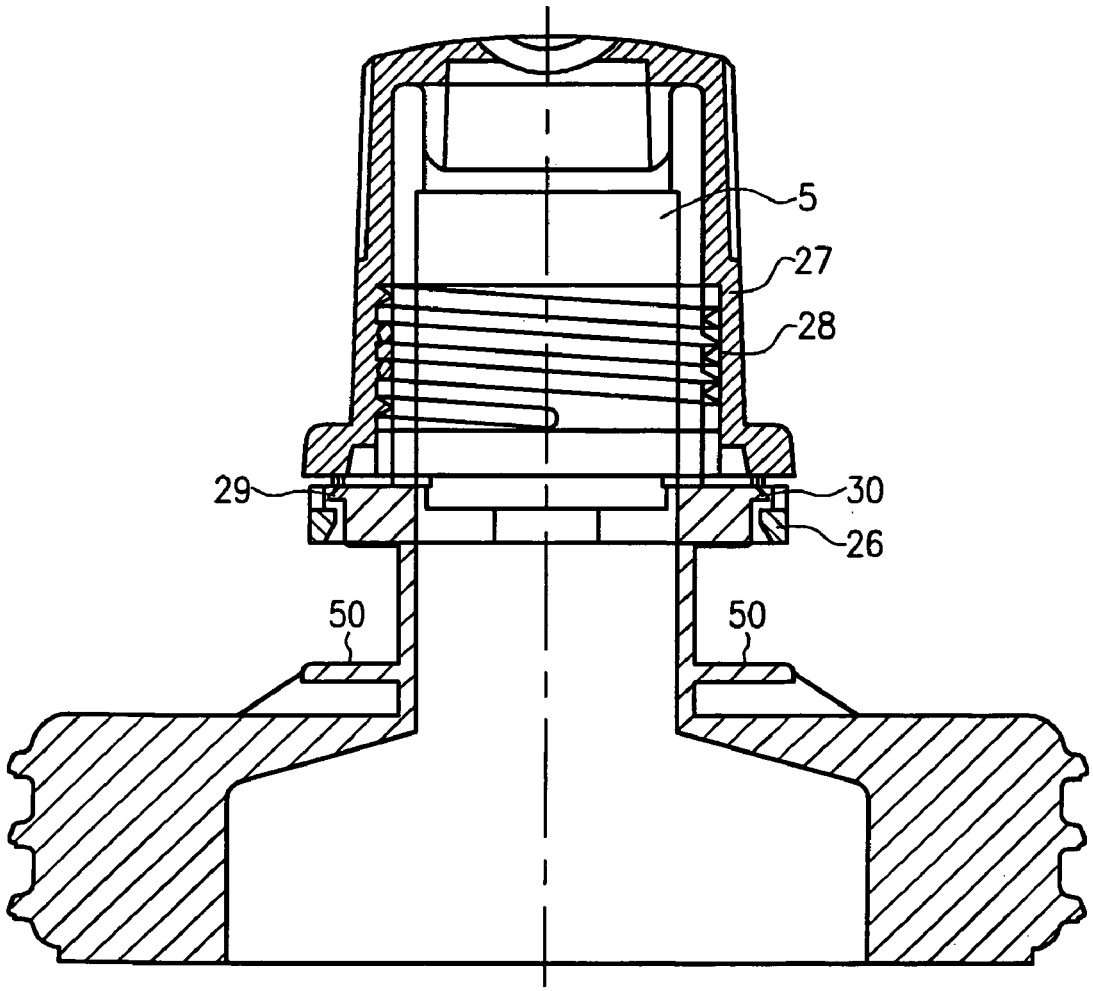
FIG. 9 is a longitudinal section through a closing element of the invention according to a further embodiment of the invention.
Figure 10:
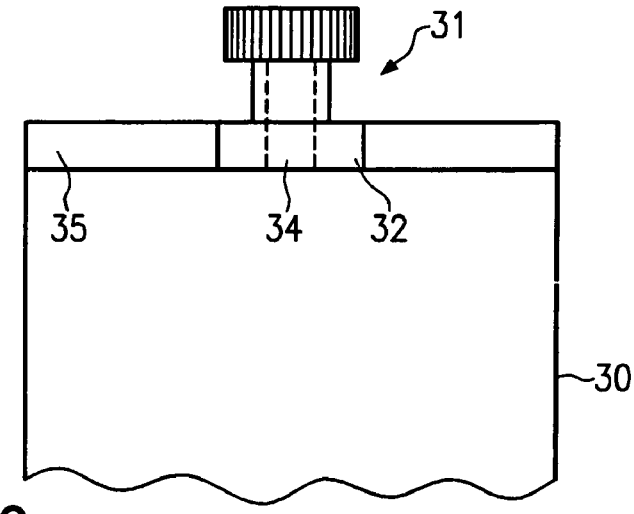
FIG. 10 schematically shows a film bag with closing element as known from the prior art.

In the embodiment illustrated in FIG. 9, the closing element is closed by a screw cap. The screw cap 27 is provided with a single-threaded or multi-threaded inner thread 28 on its inner surface. Corresponding threads are realized on the outside of the spout member 5. In this instance, too, tamper proofness is provided by a ring 26 which is held via webs 29 on the cap and snapped over a collar 30 when the cap is screwed on and which remains suspended from the collar during the opening movement in the opposite direction. Upon further rotation in the opening direction, the webs will tear off, and the ring will fall downwards, so that it can be seen immediately that the closure has been opened. Although the screw thread is formed with a single thread in FIG. 9, a multi-threaded screw thread is also possible.

We claim:

1. A closing element for a packaging for receiving liquid or paste-like material, the closing element comprising:

a closable spout member;

a weld member connected to said closable spout member, the weld member having a longitudinal extension and a width extension, the longitudinal extension being greater than the width extension; and an outlet channel having a central axis, wherein the outlet channel and the central axis extend through said weld member and said spout member, the outlet channel in said weld member having an outlet width being substantially constant and an outlet length that gradually decreases toward the spout member until the outlet length is substantially identical to the diameter of the outlet channel in the spout member, the outlet length being greater than the outlet width in the weld member, wherein the outlet width in the weld member is substantially equal to the outlet width in the spout member;

wherein said outlet channel in said weld member extends at least in part in funnel-like manner towards said spout member;

wherein said outlet channel in said spout member has a substantially cylindrical shape having a diameter that is substantially constant wherein the diameter corresponds to the constant width of the weld member.

2. The closing element according to claim 1, wherein said outlet channel in said weld member extends in funnel-like manner at an angle (γ) of 20° to 85° relative to the longitudinal axis (L) of said closing element.

3. The closing element according to claim 1, said outlet channel having a parallel portion at least partially substantially parallel to the longitudinal axis of said closing element, the parallel portion being distal to the spout member, and a tapered portion which tapers towards said spout member, the tapered portion being proximal to the spout member.

4. The closing element according to claim 1, wherein said outlet channel in said spout member has the shape of a hollow cylinder.

5. The closing element according to claim 1, wherein said spout member can be closed with a cap via a bayonet lock.

6. The closing element according to claim 1, wherein said spout member includes an end that faces away from the weld member, the end having a smooth surface for a mouthpiece.

7. The closing element according to claim 6, wherein:

said spout member can be closed with a cap via a bayonet lock; and said smooth surface is positioned above said bayonet lock.

8. The closing element according to claim 1, wherein said weld member comprises attached beads.

9. The closing element according to claim 8, wherein at least two beads extend spaced-apart from the upper and lower edges of said weld member.

10. A film bag comprising the closing element of claims 1.

11. The film bag of claim 10 wherein the closing element is welded or adhesively fixed between a first side wall and a second side wall of said film bag.

12. The film bag of claim 10, wherein:

the film bag includes a first shoulder and a second shoulder; and the closing element is disposed between the first shoulder and the second shoulder, the first shoulder and the second shoulder being welded off from an outer edge of the film bag obliquely towards the closing element by one or more weld seams.

13. The film bag of claim 12, wherein:

the longitudinal extension of the weld member includes a lower edge that faces the interior of the film bag, the lower edge located adjacent to a side edge to define a tip; and the weld seams meet at the tip of the weld member.

14. A closing element for a packaging for receiving liquid or paste-like material, the closing element comprising:

a closable spout member;

a weld member connected to said closable spout member, the weld member having a first side and a second side meeting at an acute angle; and an outlet channel, which extends through said weld member and said spout member;

wherein said outlet channel in said weld member extends at least in part in a funnel-like manner towards said spout member, wherein the outlet channel has a length and a width within the weld member, the length being greater than the width, wherein the length gradually decreases toward the spout member until the length is substantially identical to the diameter of the outlet channel in the spout member and the width of the outlet channel in the weld member remains the same within the weld member, wherein the outlet width in the weld member is substantially equal to the outlet width in the spout member;

wherein the outlet channel in said spout member has a substantially cylindrical shape having a diameter that is substantially constant and corresponds to the width of the outlet channel in the weld member and in the spout member.

15. The closing element according to claim 2, said outlet channel having a parallel portion at least partially substantially parallel to the longitudinal axis of said closing element, the parallel portion being distal to the spout member, and a tapered portion which tapers towards said spout member, the tapered portion being proximal to the spout member.

16. The closing element according to claim 2, wherein said outlet channel in said spout member has the shape of a hollow cylinder.

17. The closing element according to claim 2, wherein said spout member can be closed with a cap via a bayonet lock.

18. The closing element according to claim 2, wherein said spout member includes an end that faces away from the weld member, the end having a smooth surface for a mouthpiece.

19. The film bag of claim 11, wherein:

the film bag includes a first shoulder and a second shoulder; and the closing element is disposed between the first shoulder and the second shoulder, the first shoulder and the second shoulder being welded off an outer edge of the film bag obliquely towards the closing element by one or more weld seams.

20. The film bag of claim 11 wherein the closing element, is disposed proximate a substantially top center position of the film bag.

21. The film bag of claim 11 wherein the closing element is disposed proximate a substantially top corner position of the film hag.

22. The film bag of claim 19, wherein:

the longitudinal extension of the weld member includes a lower edge that faces the interior of the film bag, the lower edge located adjacent to a side edge to define a tip; and the weld seams meet at the tip of the weld member.

* * * * *